US005937510A

United States Patent [19]

Seiersen et al.

[11] Patent Number: 5,937,510

[45] Date of Patent: Aug. 17, 1999

[54] SHUT HEIGHT ADJUSTMENT MECHANISM FOR A TERMINAL APPLICATOR

[75] Inventors: William Kay Seiersen, Hershey; Charles Edwin Fitz, Jr., Harrisburg, both of Pa.

[73] Assignee: The Whitaker Corporation, Wilmington, Del.

[21] Appl. No.: 08/902,787

[22] Filed: Jul. 30, 1997

[51] Int. Cl.[6] ..... H01R 43/04

[52] U.S. Cl. ..... 29/753; 29/751; 72/441; 72/446

[58] Field of Search ..... 29/33 M, 751, 29/753, 755, 861, 863; 72/409.06, 409.14, 413, 331, 712, 441, 446

[56] References Cited

U.S. PATENT DOCUMENTS

| | | | |
|---|---|---|---|
| 3,911,717 | 10/1975 | Yuda | 72/331 |
| 4,790,173 | 12/1988 | Boutcher, Jr. | 72/446 |
| 5,131,124 | 7/1992 | Skotek | 29/33 M |
| 5,228,326 | 7/1993 | Wasilko et al. | 72/446 |
| 5,289,713 | 3/1994 | Schafer | 72/446 |
| 5,323,634 | 6/1994 | Wolfe et al. | 29/753 |
| 5,479,818 | 1/1996 | Walter et al. | 73/116 |
| 5,481,796 | 1/1996 | Quinn | 29/753 |
| 5,483,739 | 1/1996 | Smith et al. | 29/753 |
| 5,517,749 | 5/1996 | Zuin | 29/753 |
| 5,594,665 | 1/1997 | Walter et al. | 364/528.36 |

FOREIGN PATENT DOCUMENTS

| | | | |
|---|---|---|---|
| 4413287 | 11/1995 | Germany | H01R 43/048 |
| 2278559 | 12/1994 | United Kingdom | H01R 43/04 |

OTHER PUBLICATIONS

International Search Report in corresponding PCT/US98/15740 mailed Nov. 12, 1998; two pages.

*Primary Examiner*—Lee W. Young
*Assistant Examiner*—Rick Kiltae Chang

[57] ABSTRACT

A terminal applicator (10) is disclosed having a shut height adjustment mechanism (60) for controlling the shut height (160) of the terminal barrel crimping bar (26). The mechanism includes upper and lower adjusting members (66, 64) having opposed ramp surfaces (110, 80), the lower adjusting member being attached to the tooling ram (36) and the upper adjusting member being rotationally coupled to the ram. By incrementally rotating the upper adjusting member (66), the relative spacing between a press ram (148) and the tooling ram assembly (18) can be adjusted, thereby changing the shut height (160) of the barrel crimping bar (26). The upper adjusting member includes an inner cylindrical surface (120) having serrations (122) formed therein that are engaged by resilient projections (98) that extend from an outer cylindrical surface (90) of the lower adjusting member (64). These resilient projections (98) cam out of the serrations (122) during rotation of the upper adjusting member (66), but hold the upper adjusting member in position during operation of the applicator.

11 Claims, 6 Drawing Sheets

SHUT HEIGHT ADJUSTMENT MECHANISM FOR A TERMINAL APPLICATOR

The present invention relates to applicators for attaching terminals to wires and more particularly to an adjusting mechanism for accurately controlling the shut height of the terminal crimping bar.

BACKGROUND OF THE INVENTION

Terminal applicators which are used in conjunction with a press for attaching terminals to the ends of wires usually include a frame, a tooling ram slidingly coupled to the frame, crimping tooling attached to the tooling ram and the frame, and a terminal feed mechanism. An example of such a terminal applicator is disclosed in U.S. Pat. No. 5,481,796 which issued Jan. 9, 1996 to Quinn. The applicator of the '796 patent is held in a press which has a press ram that is coupled to the applicator tooling ram and drives it through its working stroke to attach the terminal to the end of the wire. These applicators are designed, as much as possible, to be universal in that they will accommodate a wide range of terminals. Because there are many different types of terminals and a variety of different sizes, each having its own specific crimp height for a high quality crimped connection, the mechanism for controlling the crimp height must be able to accurately adjust the applicator to a wide variety of shut height spacings. The shut height adjusting mechanism which controls crimp height, as shown in the 1796 patent, includes a pair of rotatable discs that are interposed between the tooling ram and the press ram.

The upper disc includes four pairs of raised portions that are positionable so that only two at a time are in engagement with the press ram. Each pair of raised portions are of a different height so that by positioning a desired pair in alignment with the press ram, the shut height of the terminal barrel crimping bar can be set to a desired value. However, since only four different barrel shut heights can be accommodated with a particular pair of discs, sets of discs having raised portions of different height must be provided. These disc sets are expensive and require that the applicator be taken out of service while the discs are changed. To increase the adjusting capacity of the upper disc a single disc was developed having removable buttons of selected thicknesses instead of the raised portions. Such a structure is disclosed in U.S. Pat. No 5,323,634 which issued Jun. 28, 1994 to Wolfe, et al. By changing only the buttons the shut height of the barrel crimping bar can be changed to any desired value. However, this still required that a large number of different sized buttons be maintained on hand. In another example, the single upper disc was developed having a ramp surface that is wound about the ram's axis so that the surface of the ramp is facing downwardly in the direction of movement of the ram during the crimping operation. This mechanism, disclosed in U.S. Pat. No. 5,483,739 which issued Jan. 16, 1996 to Smith et al., is intended to accommodate a wider range of shut heights and to accurately select a desired shut height. The top of the crimping bar is in abutting engagement with the ramp surface. By rotating the disc so that the area of the ramp surface in contact with the crimping bar moves up or down the shut height of the crimping bar can be changed. A series of holes are formed in the disc near its periphery and are in alignment with a pair of ball plungers that serve as a detent to hold the disc in a desired position. The spacing of the holes and the diameters of the ball plungers limit the incremental resolution of the mechanism to about 0.0007 inch, which is an improvement over the prior art devices but still does not meet the accuracy requirements of certain applications. A further disadvantage of this arrangement is that the ramp surface is subjected to substantial local pressures in the relatively small area in contact with the top of the crimping bar, which can cause uneven wear of the ramp surface.

What is needed is an adjusting mechanism that will permit a large number of different shut height spacings without the need to change parts or to take the applicator out of service while making the adjustment and that will provide an incremental resolution of the selected shut height of about 0.0005 inch while not subjecting the mechanism to undue wear.

SUMMARY OF THE INVENTION

A terminal applicator is provided for attaching a terminal to a wire. The applicator includes a base, a tooling ram coupled to the base arranged to undergo reciprocating motion along a tooling ram axis in a first direction toward the base and in a second direction away from the base. The tooling ram is coupled to and driven -by a press ram wherein the press ram and the tooling ram are in a first spaced relationship during movement in the first direction. The applicator includes lower tooling attached to the base and a terminal barrel crimping bar coupled to the tooling ram. The first -spaced relationship defines a first shut height between the terminal barrel crimping bar and the lower tooling. A shut height adjusting mechanism is provided for selectively adjusting the first shut height and includes an adjusting member and a fixed member. The adjusting member is rotationally coupled to the tooling ram and arranged for angular movement about the ram axis, and includes an inner cylindrical surface extending therefrom. The fixed member is attached to the ram in engagement with the adjusting member so that the angular movement of the adjusting member changes the first spaced relationship. The fixed member has an outer cylindrical surface attached thereto that is coaxial with and encircled by the inner cylindrical surface. A plurality of depressions are formed in and closely spaced along substantially the entire surface of one of the inner and outer cylindrical surfaces. A pair of diametrically opposed first projections are coupled to the other of the inner and outer cylindrical surfaces and resiliently urged into engagement with respective ones of the plurality of depressions for releasably holding the adjusting member in a desired angular position.

DESCRIPTION OF THE PREFERRED EMBODIMENT

Figure 2:
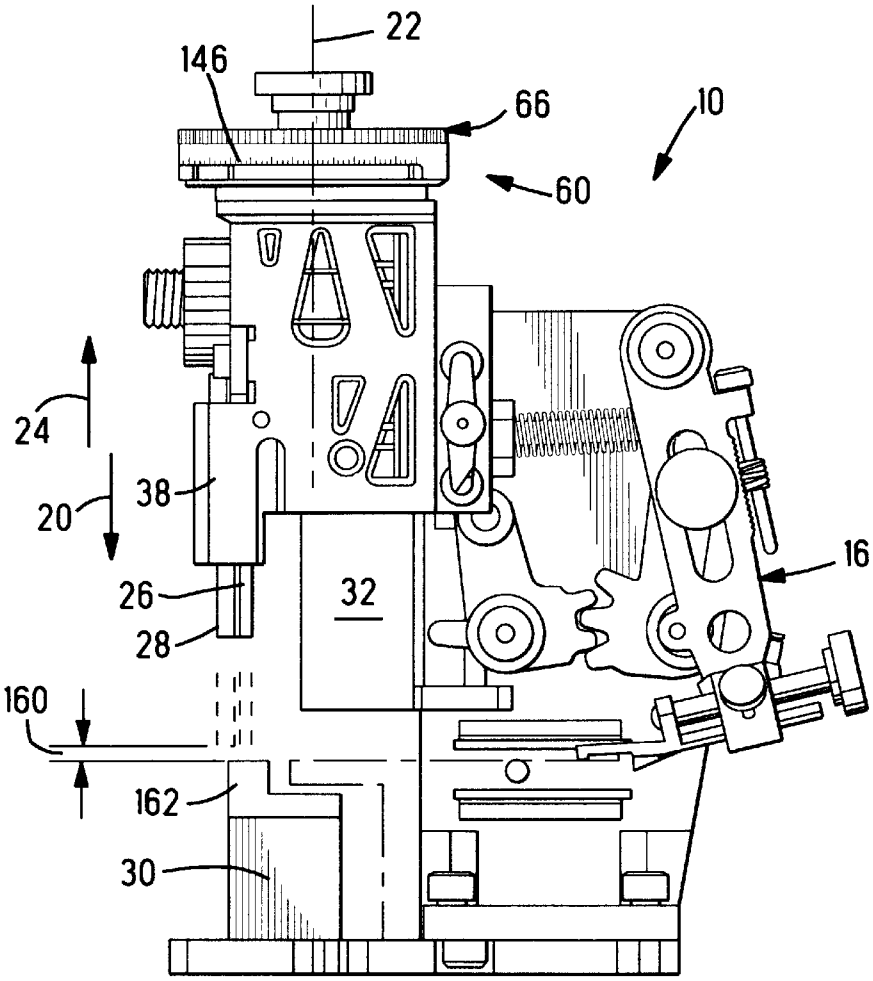
FIGS. 1 and 2 are front and side views, respectively, of a terminal applicator incorporating the teachings of the present invention.
Figure 1:
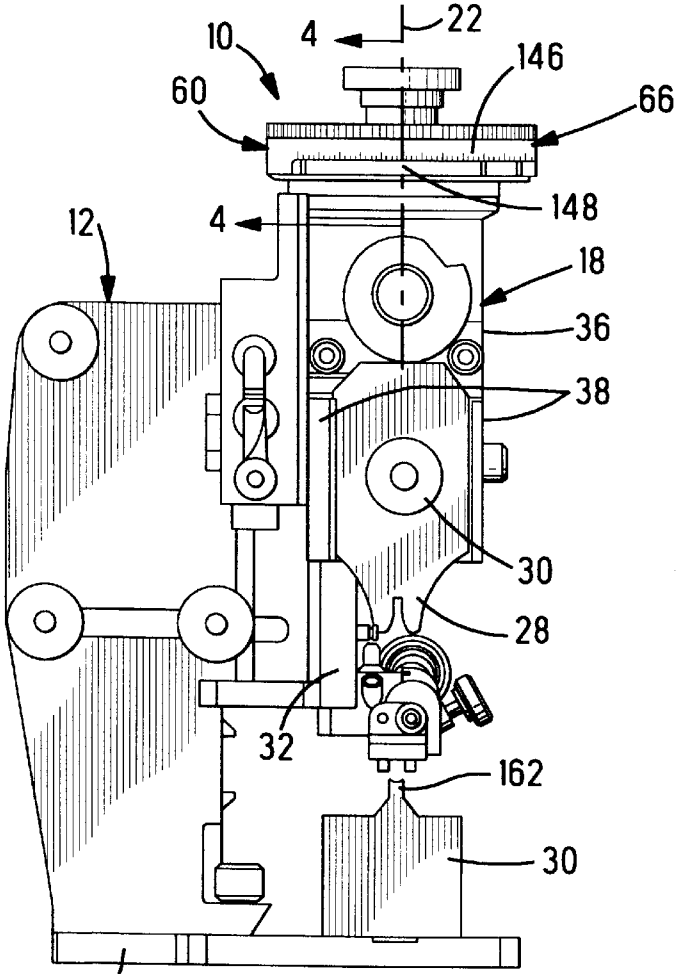

There is shown in FIGS. 1 and 2 a terminal applicator 10 having a frame 12 including a base 14, a terminal feed mechanism 16, and a tooling ram assembly 18 coupled to the frame and arranged for reciprocating motion toward the base 14 in a first direction 20 along a ram axis 22 and away from the base in an opposite second direction 24. The ram assembly slides along a ram way 32 that is attached to the frame 12. The tooling ram assembly carries upper tooling consisting of a terminal barrel crimping bar 26 and an insulation tab crimping bar 28 that cooperate with lower tooling 30 attached to the base 14, for attaching a terminal, not shown, that is fed along a terminal feed path by the feed mechanism 16.

Figure 3:
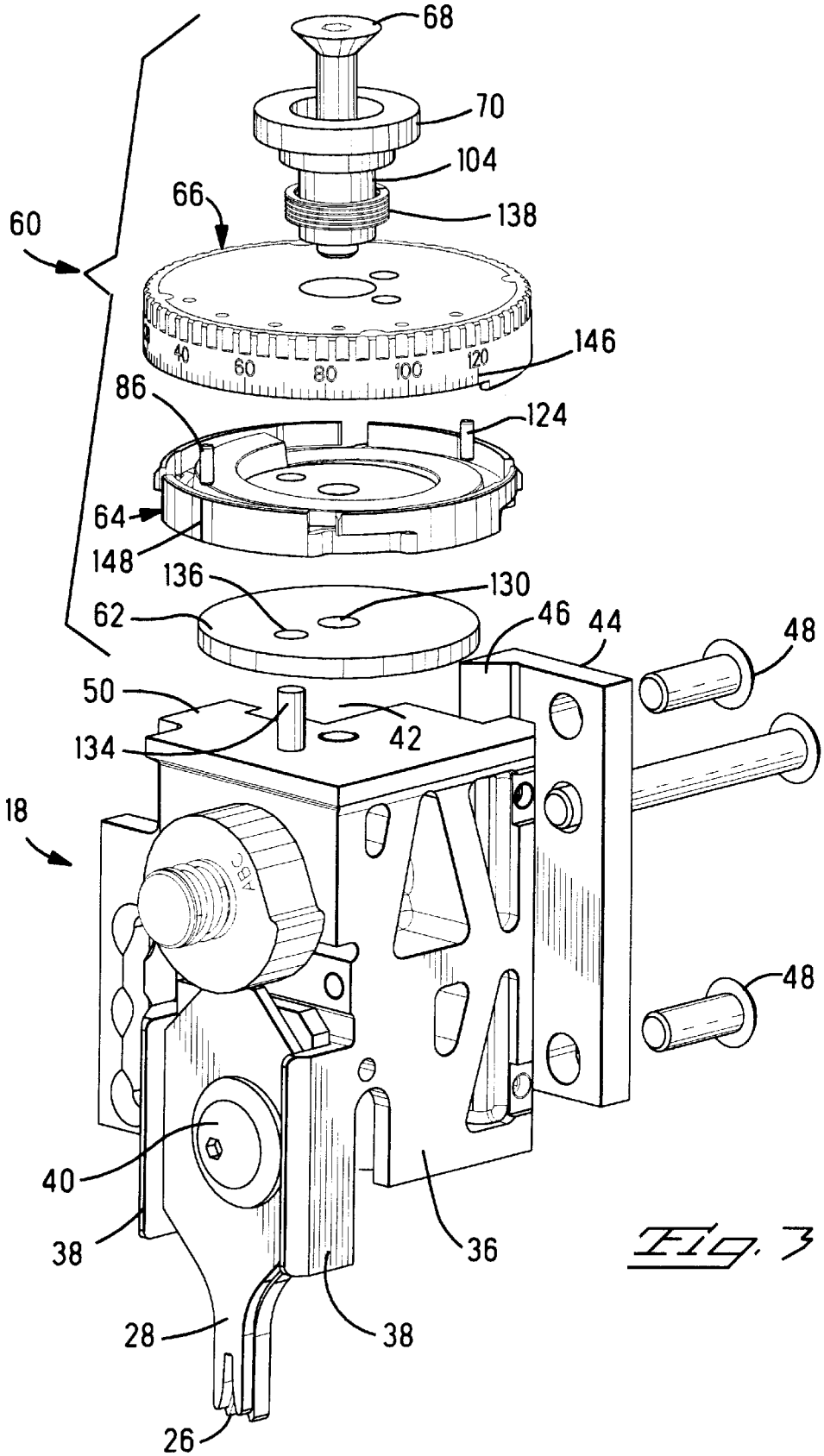
FIG. 3 is a partial exploded view of the ram assembly shown in FIG. 1.

The tooling ram assembly 18, as best seen in FIG. 3, includes a ram 36 having a pair of opposed flanges 38 that hold the crimping bars 26 and 28 in alignment. The two crimping bars 26 and 28 are held in position by means of a screw 40 in the usual manner. An opening 42 is formed along a side of the ram 36 for slidingly receiving the ram way 32. A gib 44 having an angled surface 46 is attached to the ram 36 by means of screws 48 so that the angled surface slidingly engages the ram way 32, in the usual manner. The ram 36 includes a top mounting surface 50 to which a shut height adjusting mechanism 60 is secured, shown in exploded parts format in FIG. 3. The shut height adjusting mechanism 60 includes a spacer disc 62, and lower and upper adjusting members 64 and 66 which are secured to the tooling ram by means of a screw 68 and a ram post 70, as will be described below.

Figure 8:
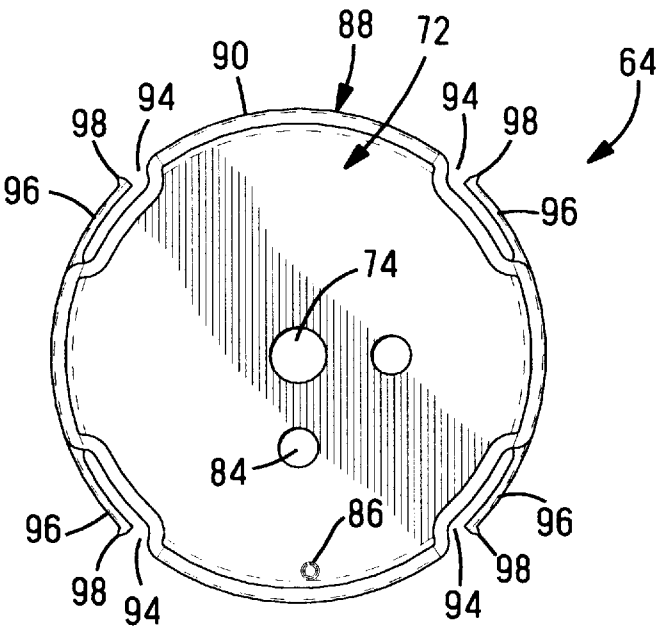
FIGS. 6, 7, and 8 are top, side, and bottom views, respectively, of the lower adjusting member.
Figure 7:
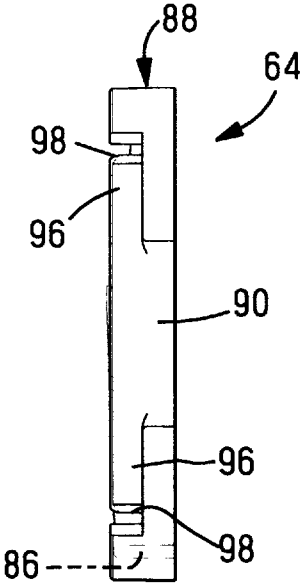
Figure 6:
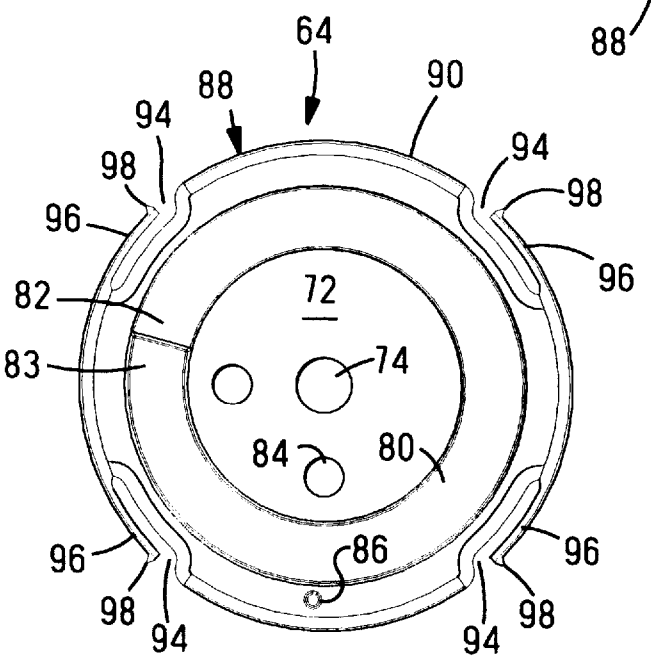
Figure 11:
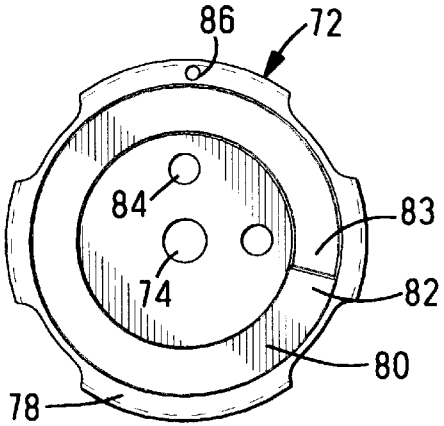
FIGS. 9, 10, and 11 are bottom, side, and top views of the lower ramp member shown in FIG. 5.
Figure 9:
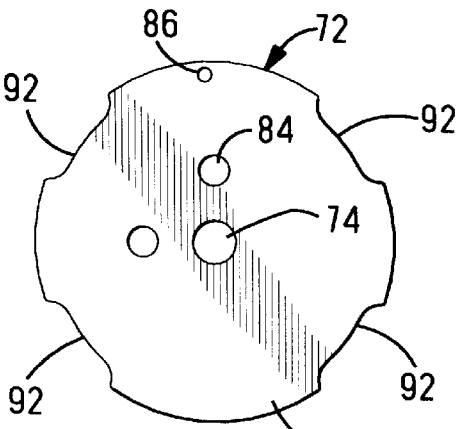

As best seen in FIGS. 4 through 11, the lower adjusting member 64 includes a lower disc 72 having a central concentric hole 74 that is a close fit clearance hole for the screw 68. The lower disc 72 has first and second parallel major surfaces 76 and 78. A ramp surface 80 rises smoothly and continuously from the surface 78, beginning at a point 82 where it is close to the surface 78 and rotating clockwise, as viewed in FIG. 11, to a point 83 where it is furthest from the surface 78. A pin hole 84 is formed through the lower disc 72, as shown in FIGS. 9 and 11, for receiving a locating pin as will be explained. Additionally, a spring pin 86 is disposed in a hole in the disc so that it extends between the outer shell 88 and the ramp surface 80, for a purpose that will be explained. An outer shell 88 is insert molded to the outer periphery of the lower disc 72 forming an outer cylindrical surface 90. The lower disc 72 includes four equally spaced cutouts 92 in its periphery which are mirrored as cutouts 94 in the outer shell 88. A thinned portion of the outer shell partially extends over each cutout 94 thereby forming a cantilevered resilient beam 96 associated with each cutout. Each beam 96 has a V-shaped projection 98 on its free end that is directed outwardly, as best seen in FIGS. 6 and 8, for a purpose that will be explained. Each beam 96 is resilient so that its free end can be deflected inwardly into the cutout 94 a small amount and when released will return to its original position.

Figure 4:
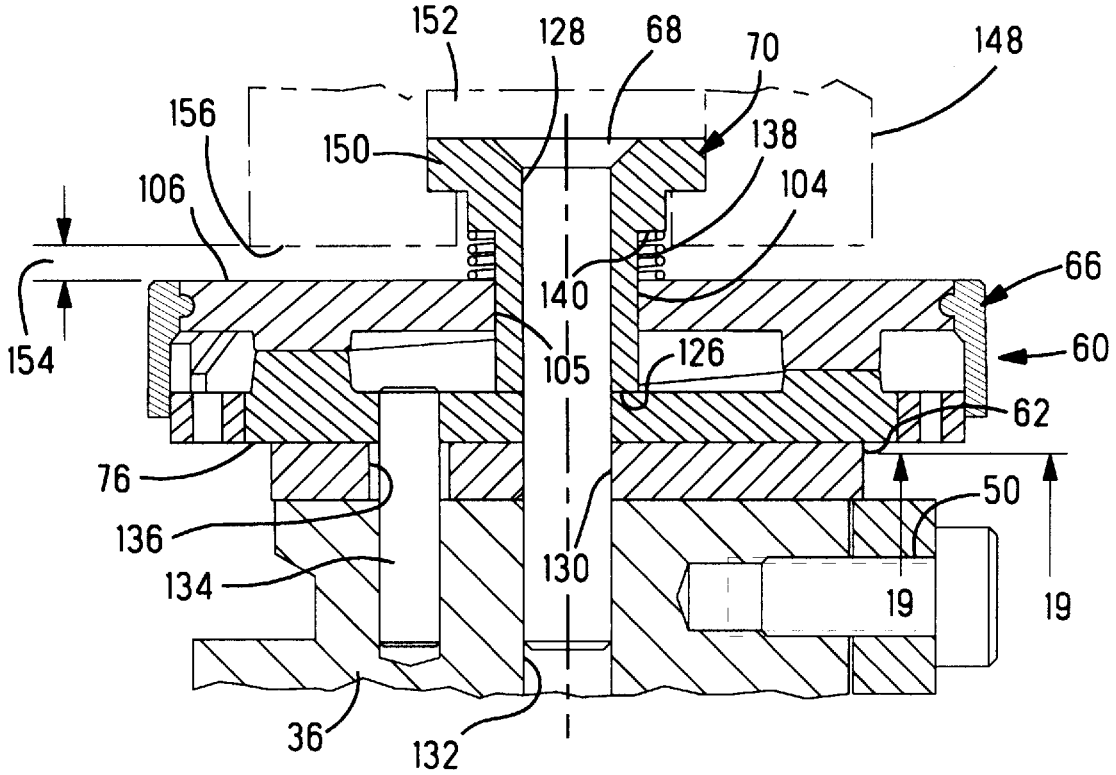
FIG. 4 is a cross-sectional view taken along the lines 4—4 in FIG. 1.
Figure 19:
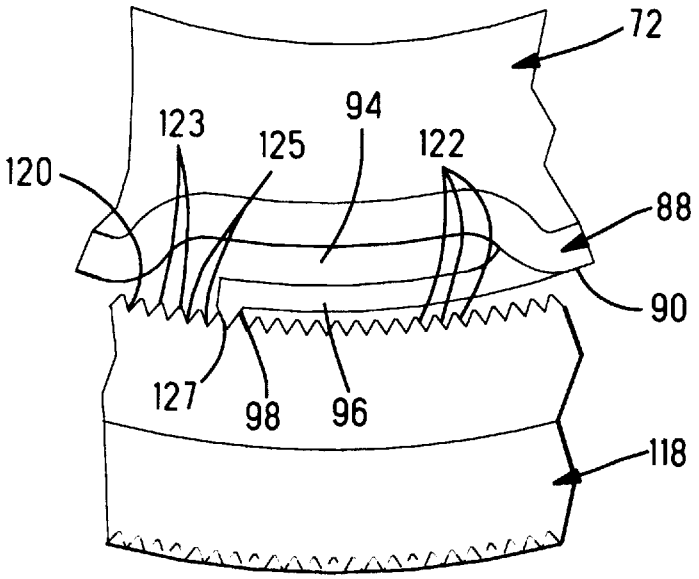
FIG. 19 is a enlarged view of a portion of the shut height adjusting mechanism taken along the lines 19—19 in FIG. 4.
Figure 5:
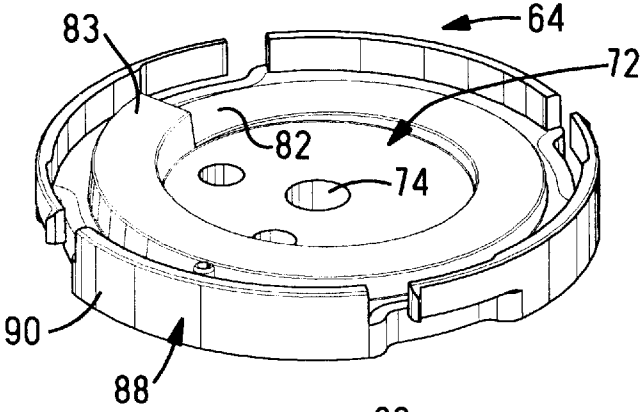
FIG. 5 is an isometric view of the lower adjusting member shown in FIG. 3.
Figure 18:
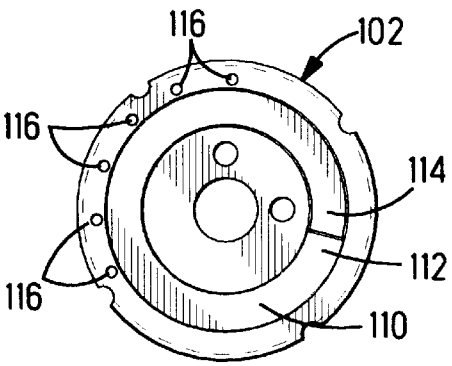
FIGS. 16, 17, and 18 are top, side, and bottom views, respectively, of the upper ramp member shown in FIG. 12.
Figure 10:
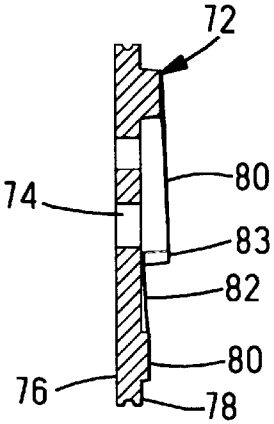
Figure 17:
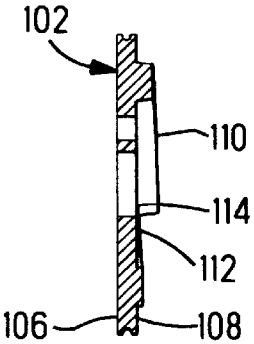
Figure 16:
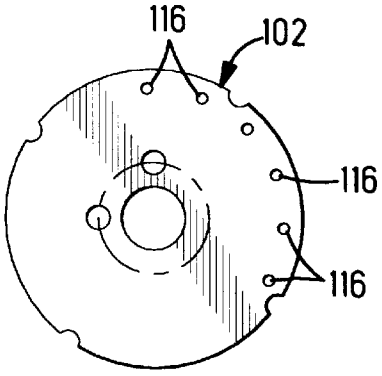
Figure 12:
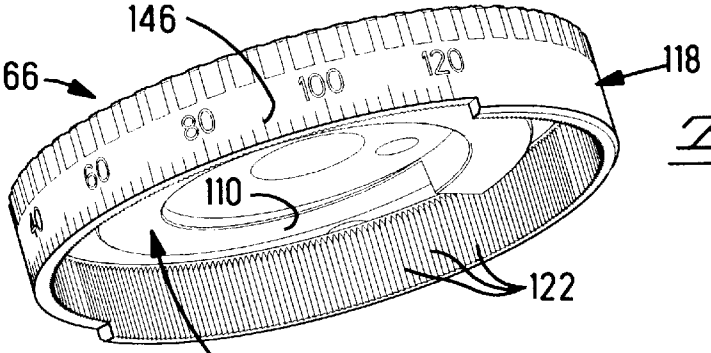
FIG. 12 is an isometric view of the upper adjusting member shown in FIG. 3.
Figure 15:
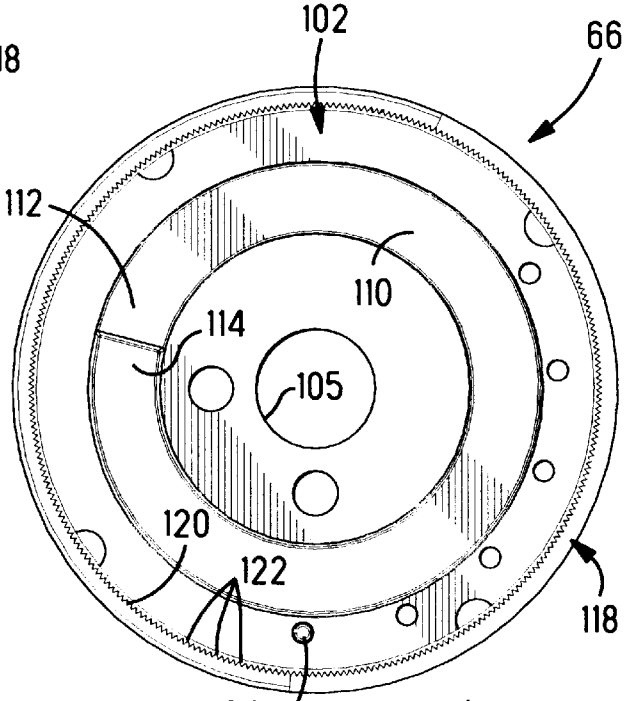
FIGS. 13, 14, and 15 are top, side, and bottom views, respectively, of the upper adjusting member shown in FIG. 12.
Figure 14:
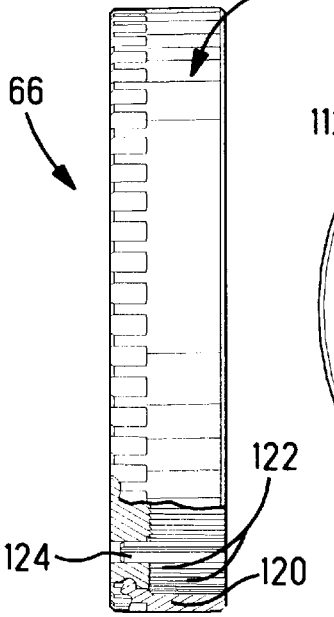
Figure 13:
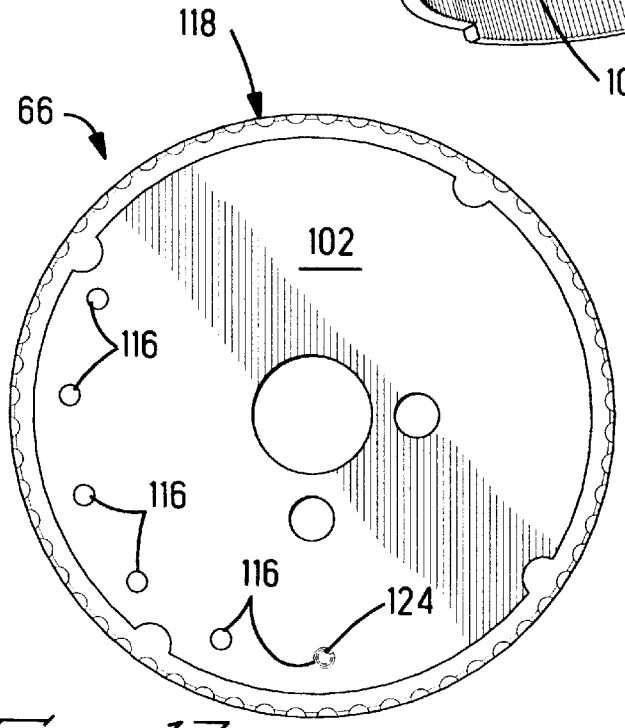

As best seen in FIGS. 4 and 12 through 18, the upper adjusting member 66 includes an upper disc 102 having a central concentric hole 105 that is a slip fit with a reduced diameter 104 of the ram post 70, as shown in FIG. 4, so that it is free to rotate on the ram post. The upper disc 102 has first and second parallel major surfaces 106 and 108. A ramp surface 110 rises smoothly and continuously from the surface 108, beginning at a point 112 where it is close to the surface 108 and rotating clockwise, as viewed in FIGS. 15 and 18, to a point 114 where it is furthest from the surface 108. The upper disc 102 has several pin holes 116 that are formed through the disc similar to the pin hole 86 on a common bolt circle therewith, and that are spaced apart as shown in FIGS. 16 and 18, for a purpose that will be explained. An outer shell 118 is insert molded to the outer periphery of the upper disc 102 forming an inner cylindrical surface 120, as shown in FIGS. 12, 14, and 15. A series of equally spaced V-shaped openings or serrations 122 are formed in the inner cylindrical surface 120 for its entire circumference. Each serration 122 is sized and shaped to closely receive one of the V-shaped projections 98, as best seen in FIG. 19. The actual shape of the projections 98 and serrations 122 may be other than V-shaped. For example, they may be U-shaped or their corners 123, 125, and 127 may be radiused or squared off as desired. It is important, however, that each projection 98 be closely received in each serration 122 for providing a detent effect that will prevent rotation of the upper adjusting member 66 during operation of the applicator 10. A spring pin 124 is disposed in a selected one of the holes 116 so that it extends between the ramp surface 110 and the inner cylindrical surface 120, as shown in FIG. 14. The pins 86 and 124 are positioned on the same bolt circle so that they interfere and serve as stop members when the upper adjusting member 66 is rotated sufficiently far. The particular hole selected for the pin 124 determines the amount of rotation permitted. As best seen in FIGS. 3 and 4, the lower adjusting member 64 and the spacer disc 62 are stacked on the top surface 50 and secured there by the end 126 of the ram post 70 which is held tightly against the lower adjusting member by the screw 68. The screw 68 extends through a countersunk hole 128 formed axially through the ram post 70, through the hole 74 in the lower adjusting member, through a clearance hole 130 in the spacer disc, and into a threaded hole 132 formed in the ram 36. A pin 134 is pressed into a hole in the ram 36 and extends above the top surface 50, through a clearance hole 136 in the spacer disc 62, and into the pin hole 84 in the lower adjusting member 64, as best seen in FIG. 4. This prevents rotation of the lower adjusting member 64 with respect to the ram 36. As can be seen in FIGS. 3 and 4, the lower and upper adjusting members 64 and 66 are arranged so that their respective ramp surfaces 80 and 110 are opposed and in mutual engagement, with the lower adjusting member fixed against rotation and the upper ramp member free to rotate about the ram axis 22. A compression spring 138 is disposed around the reduced diameter 104 of the ram post 70 between a shoulder 140 and the surface 106 of the upper adjusting member 66. This keeps the upper and lower ramp surfaces in engagement and allows sufficient room for axial movement of the upper adjusting member during adjustment.

The shut height of the applicator 10 is adjusted by rotating the upper adjusting member 66 about the reduced diameter 104. The projections 98 will cam out of the serrations 122 and then immediately snap back into the adjacent serrations 122, thereby functioning as a detent. This permits the easy rotation of the upper adjusting member 66 by simply applying a rotational force to the outer shell 118. When the rotational force is removed the projections 98 interferingly engage the serrations 122, thereby holding the upper adjusting member 66 in its current position with respect to the lower adjusting member. As shown in FIGS. 1, 2, 3, and 12, the upper adjusting member 66 includes indices 146 on its outer peripheral surface that can be aligned with a home mark 148, shown in FIG. 1 and 3, used for reference when adjusting the shut height of the terminal barrel crimping bar 26. As best seen in FIG. 4, the tooling ram assembly 18 is coupled to a press ram 148, shown in phantom lines, by means of the ram post 70. The ram post 70 includes an enlarged head 150 that rides in a T-slot 152 formed in the press ram. There may be a small amount of vertical play 154 between the press ram 148 and the surface 106 of the upper adjusting member 66 that is taken out during the downward stroke of the press ram as the crimping bars 26 and 28 engage the terminal. During this downward stroke the lower surface 156 of the press ram 148 is in abutting engagement with the surface 106 of the upper adjusting member 66. As best seen in FIG. 2, the shut height 160 is the distance between the forming portion of the barrel crimping bar 26 and the anvil 162 of the lower tooling 30 when the tooling ram 36 is in its full down position. This distance can be selectively changed by simply rotating the upper adjusting member 66 with respect to the lower adjusting member 64 so that the two opposing ramp surfaces 110 and 80 cause the two opposite surfaces 106 and 76 of the upper and lower adjusting members, as best seen in FIG. 4, to become closer together or further apart. This results in changing the spaced relationship of the tooling ram 36 to the press ram 148 by moving the entire tooling ram assembly 18 closer to or further away from the surface 156 of the press ram. As set forth above, when incrementally rotating the upper adjusting member 66, the projections 98 will cam out of the serrations 120 and then immediately snap back into interfering engagement with the adjacent serrations 120, thereby holding the upper adjusting member in its new position with respect to the lower adjusting member.

When larger adjustments of the shut height 160 are required than can be accommodated by rotating the upper adjusting member 66, the spacer plate 62 may be removed and replaced by another spacer plate of different thickness. A spacer plate of less thickness results in a range of increased shut heights and a spacer plate of more thickness results in a range of reduced shut heights. While the two ramp surfaces 110 and 80 of the upper and lower adjusting members 66 and 64 provide an infinite number of settings as the upper adjusting member is rotated, practically, there are only discrete spaced apart settings that are usable due to the discrete positioning effect of the projections 98 in engagement with the serrations 120. However, the serrations are of rather fine pitch, 1.250 degrees per depression in the present example. This results in the capability to fine adjust the shut height 160 in incremental amounts of plus or minus 0.0005 inch. The two ramp surfaces 110 and 80 include a substantial contact area to distribute the crimping forces so that the mechanism is not subjected to undue wear.

An important advantage of the present invention is that a wide range of very fine adjustments can be made to the shut height of the barrel crimping bar, many more and finer adjustments than are possible with the prior art mechanisms. Additionally, for most adjustment ranges, all adjustments can be made without taking the applicator out of service, removing the adjusting discs, and replacing them with discs of a different size, as is required by the prior art mechanisms. Further, since a large inventory of adjusting discs are no longer needed, the expense associated therewith is avoided.

We claim:

1. In a terminal applicator for attaching a terminal to a wire, said applicator having a base, a tooling ram coupled to said base arranged to undergo reciprocating motion along a tooling ram axis in a first direction toward said base and in a second direction away from said base, said tooling ram being coupled to and driven by a press ram wherein said press ram and said tooling ram are in a first spaced relationship during movement in said first direction, including lower tooling attached to said base, a terminal barrel crimping bar coupled to said tooling ram, wherein said first spaced relationship defines a first shut height between said terminal barrel crimping bar and said lower tooling, a shut height adjusting mechanism for selectively adjusting said first shut height comprising:

(1) an adjusting member rotationally coupled to said tooling ram and arranged for angular movement about said ram axis, said adjusting member having an inner cylindrical surface extending therefrom;

(2) a fixed member attached to said ram in engagement with said adjusting member so that said angular movement changes said first spaced relationship, said fixed member having an outer cylindrical surface attached thereto coaxial with and encircled by said inner cylindrical surface;

(3) a plurality of depressions in and closely spaced along substantially all of said inner cylindrical surface; and (4) a pair of diametrically opposed first projections coupled to said outer cylindrical surface, resiliently urged into engagement with respective ones of said plurality of depressions for releasably holding said adjusting member in a desired angular position.

2. The applicator according to claim 1 wherein each said first protection is coupled to said outer cylindrical surface by means of a first resilient beam extending from said outer cylindrical surface, each said first projection extending outwardly from an end of said first beam.

3. The applicator according to claim 2 including a pair of diametrically opposed second projections, each said second projection being coupled to said outer cylindrical surface by means of a resilient second beam extending from said outer cylindrical surface, and each said second projection extending outwardly from an end of said second beam.

4. The applicator according to claim 3 wherein each of said first projections is equally spaced between said pair of second projections.

5. The applicator according to claim 4, wherein said first projections and second projections are urged by said first and second beams, respectively, into locking engagement with respective ones of said plurality of depressions so that upon rotation of said adjusting member said first projections and said second projections cam out of respective ones of said depressions thereby permitting selected rotation of said adjusting member.

6. The applicator according to claim 1 wherein said adjusting member includes a first ramp face and said fixed member includes a second ramp face in mating engagement with said first ramp face so that said angular movement of said adjusting member said first ramp face slides along said second ramp face thereby said changes of said first spaced relationship.

7. The applicator according to claim 6 wherein said first ramp face is formed on a first ramp member attached to said adjusting member and said second ramp face is formed on a second ramp member attached to said fixed member.

8. The applicator according to claim 7 wherein a portion of said adjusting member is insert molded to said first ramp member, and a portion of said fixed member is insert molded to said second ramp member.

9. The applicator according to claim 8 wherein said press ram is in engagement with a face of said second ramp member opposite said second ramp face so that said press ram is in force transmitting relationship with said tooling ram through said first and second ramp faces, wherein upon rotation of said adjusting member in one direction said press ram and said tooling ram are moved further apart, and upon rotation of said adjusting member in a direction opposite to said one direction, said press ram and said tooling ram are moved closer together.

10. The applicator according to claim 9 including a first stop member associated with said first ramp member and a second stop member associated with said second ramp member arranged to mutually interfere to limit the amount of said rotation of said second ramp member.

11. The applicator according to claim 9 wherein said first stop member is a pin extending from a hole in said first ramp member and said second stop member is a pin extending from a hole in said second ramp member.

* * * * *